US005137214A

United States Patent [19]

Mallery

[11] Patent Number: 5,137,214

[45] Date of Patent: Aug. 11, 1992

[54] METHOD AND APPARATUS FOR CREATING ARTIFICIAL RAIN

[75] Inventor: Richard G. Mallery, North Hollywood, Calif.

[73] Assignee: The Walt Disney Company, Glendale, Calif.

[21] Appl. No.: 500,733

[22] Filed: Mar. 28, 1990

[51] Int. Cl.[5] ..... B05B 1/26; B05B 15/04

[52] U.S. Cl. ..... 239/11; 239/498; 239/500; 239/505; 239/524

[58] Field of Search ..... 239/17, 23, 122, 498, 239/500, 505, 524, 11, 12; 272/15; 135/16, 20

[56] References Cited

U.S. PATENT DOCUMENTS

| | | | |
|---|---|---|---|
| 612,433 | 10/1898 | Orford | 239/498 X |
| 963,354 | 7/1910 | Braemer | 239/498 |
| 1,020,071 | 3/1912 | Askin | 272/15 |
| 1,434,757 | 11/1922 | Thomas . | |
| 1,745,914 | 2/1930 | Rogan . | |
| 2,727,366 | 12/1955 | Hagen | 135/16 X |
| 2,757,679 | 8/1956 | Rivkin et al. | 135/20 R |
| 2,775,482 | 12/1956 | Schutz . | |
| 2,941,695 | 6/1960 | Rich | 135/16 X |
| 3,478,759 | 11/1969 | Ehrman | 135/20 R |
| 4,066,472 | 1/1978 | Perry | 239/498 X |
| 4,855,089 | 8/1989 | Michels | 239/524 X |
| 4,953,848 | 9/1990 | Braunstein et al. | 272/8.5 |

FOREIGN PATENT DOCUMENTS

| | | | |
|---|---|---|---|
| 678082 | 8/1952 | United Kingdom | 272/15 |

*Primary Examiner*—Andres Kashnikow
*Assistant Examiner*—William Grant
*Attorney, Agent, or Firm*—Pretty, Schroeder, Brueggemann & Clark

[57] ABSTRACT

A method and apparatus is disclosed for creating artificial rain. The apparatus includes a substantially planar collection sheet having a plurality of pointed teeth along its lower edge. A water tank supplies water under pressure to an overhead manifold which feeds water to a plurality of spray nozzles adapted to spray a horizontal fan of water onto the collection sheet. As the water collects on the pointed teeth, it eventually falls off in droplet form when the volume and weight of the water overcomes its surface tension. An overspray sheet also having a plurality of pointed teeth may be positioned in spaced, parallel relation to the collection sheet to collect any overspray and convert it to drops of artificial rain. A control system regulates water pressure in the apparatus during use conditions. When the apparatus is deactivated, water is recycled in the tank while maintaining a balanced head pressure in the apparatus so that activation and deactivation takes only a few seconds.

33 Claims, 2 Drawing Sheets

METHOD AND APPARATUS FOR CREATING ARTIFICIAL RAIN

BACKGROUND OF THE INVENTION

The present invention relates to devices for creating special effects and, more particularly, to a device for producing artificial rain in droplet form.

For many years, the use of special effects in the movie and entertainment industry has been extremely important in simulating realistic situations and occurrences for the audience. Special effects also have enjoyed a wide application in the amusement park and theme park business, in which guests are exposed to the simulated effects of fire or rain, for example, while sitting in a theatre or while being transported in a ride vehicle through an attraction.

Problems have existed in the past in producing the special effect of artificial rain, especially in theme parks. Several constraints exist. For example, in producing the rain, it is highly desirable to use real water to achieve the most realistic effect. When using real water, however, the water must be controlled and contained adequately since it is being used in a dry setting. Another consideration which applies in the case of theme park installations, is the need to operate the rain producing device for up to 10–12 hours per day every day of the year, while taking into account that the device probably will be turned on and off several times a day and, in some cases, over one hundred times per day. In these situations, it is imperative that the device be relatively maintenance free and reliable in use.

Over the years, various devices have been developed for producing artificial rain for use in dry settings. The majority of such devices include a number of tiny nozzles that emit streams of water to simulate the effect of real rain. Since these nozzles emit the water in streams, rather than in droplet form like real rain, it is difficult for them to closely simulate the natural look of real rain. In order to solve this problem, extremely small nozzle orifices typically are used so as to produce the thinnest possible individual streams of water. Unfortunately, the small nozzle orifices are highly susceptible to clogging from minerals, dirt and other impurities in the water. Moreover, they still do not produce droplets like real rain.

As an alternative to using nozzles with small orifices, nozzles with larger orifices that are not as prone to clogging have been used. However, this type of device typically employs a large overhead reservoir for supplying water to the nozzles. The device highly depends on the water level in the reservoir and mini-wave action to accurately control the output of water from the nozzles. This makes the reliability of the water output from the nozzles extremely sensitive to leveling. More significantly, however, the device tends to emit unnatural looking streams of water to simulate the effect of rain, rather than producing more realistic looking droplets of water.

Accordingly, there has existed a definite need for a device for creating artificial rain that falls in droplet form like real rain. There further has existed a need for a device that can be rapidly activated and deactivated numerous times per day in an efficient and reliable manner and without significant maintenance. The present invention satisfies these needs and provides further related advantages.

SUMMARY OF THE INVENTION

The present invention is embodied in an apparatus for creating artificial rain in droplet form. The apparatus includes a collection sheet having novel droplet forming means along its lower edge adapted to create artificial raindrops from liquid applied to the sheet. The apparatus also includes novel means for applying the liquid onto the sheet, such that the liquid is formed into drops that fall by gravity from the sheet. Moreover, the apparatus of the present invention is intended to be reliable in operation, relatively inexpensive to manufacture and does not require any significant maintenance.

The apparatus of the invention, in one preferred form, comprises a substantially planar collection sheet having a plurality of pointed teeth along its lower edge. The collection sheet is maintained in a vertical position and preferably is scored in a manner that forms small grooves on the sheet in a vertical direction. A liquid such as water is applied onto the collection sheet by spray nozzles adapted to spray a horizontal fan of water under pressure which forms a thin film of water on the sheet. As the water is sprayed onto the sheet, it runs downwardly by gravity along the vertically scored grooves and collects on the pointed teeth. When the volume and weight of the water overcomes its surface tension, the water falls from the teeth in droplet form thereby producing artificial rain drops.

A significant advantage of the apparatus is that it produces artificial rain in droplet form, just like real rain. The apparatus is also capable of producing a curtain of rain having overall uniformity, but with slight variations in the directions that the droplets fall from the pointed teeth of the collection sheet. That is, as the droplets release from the pointed teeth, each releases at a slightly different angle and hits the ground in a different spot. This randomness in which the drops fall from the sheet creates a broken pattern, thereby enhancing the simulation of real rain.

In one aspect of the invention, the apparatus further includes a substantially planar overspray sheet also including a plurality of pointed teeth along its lower edge. The overspray sheet preferably is smaller in vertical dimension than the collection sheet, but is substantially the same length, with the lower edges of each sheet being aligned with each other. The overspray sheet is spaced slightly from the collection sheet so that the overspray sheet may collect excess water that is not retained by or bounces off the collection sheet during the spraying of water by the nozzles onto the collection sheet. The overspray sheet also may be scored in a vertical direction to promote the flow of water to the pointed teeth, as described above.

In the preferred embodiment, the means for applying water onto the collection sheet comprises a tank for holding a supply of water and a manifold connected to the tank by a supply line. A pump moves water under pressure from the tank through the supply line and manifold so that it can be sprayed out of the nozzles which are connected to the manifold by feed lines. The spacing between the nozzles and the collection sheet may be adjusted to achieve proper spray coverage by the nozzles with respect to the sheet.

In another aspect of the invention, a control system is provided for controlling the flow of water from the tank through the supply line, manifold and spray nozzles. The control system includes a pinch valve and a pressure control valve in the supply line for controlling the flow of water from the tank to the nozzles at a pre-determined pressure during the spraying of water onto the collection sheet. The control system also includes a pinch valve and a pressure control valve in a return line connected to the supply line upstream from the supply line's pinch valve. During normal operation, the pinch valve in the supply line is open, with the pinch valve in the return line closed, so that water is pumped under pressure through the supply line to the manifold where it is emitted from the nozzles in a horizontal spray pattern onto the collection sheet. The droplets of water falling from the pointed teeth of the collection sheet are thereafter collected in a catch trough that returns the recaptured water back to the tank for further use. When the apparatus is deactivated and the pinch valve in the supply line is closed, the pinch valve in the return line is opened so that the pump may recycle water in the tank through the supply line and return line back into the tank.

The control system gives the apparatus the ability to be activated and deactivated almost instantly, without transient pressure changes which could damage the pump. In actual use, the apparatus can be activated or deactivated in a matter of a few seconds. The system is always charged and, therefore, a minimal volume of water is kept in the tank. Moreover, since water in the system is recycled from the catch trough to the tank, additional water needs to be added to the system only to compensate for evaporation. The inexpensive and lightweight nature of the components of the apparatus also make it relatively simple to construct and easy to maintain.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
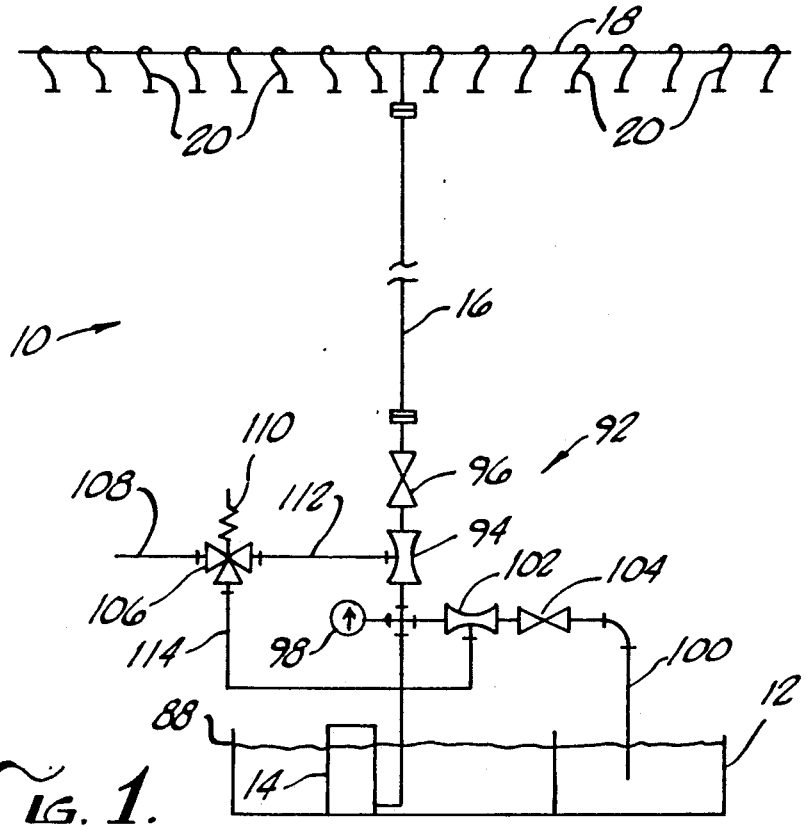
FIG. 1 is a schematic view of an apparatus for creating artificial rain embodying the novel features of the invention.

As shown in the accompanying drawings, the present invention is embodied in an apparatus, indicated generally by the reference numeral 10, for use in creating artificial rain. As shown in FIG. 1, the apparatus 10 includes a reservoir or tank 12 for holding a volume of liquid, such as water. The water is withdrawn from the tank 12 by a pump 14 which transfers the water under pressure through a supply line 16 to a manifold 18 located above the tank. A plurality of flexible feed lines 20 spaced along the manifold 18 divert water from the manifold to a corresponding number of injector pipes 22, each of which has a spray nozzle 24 at its downstream end.

Figure 2:
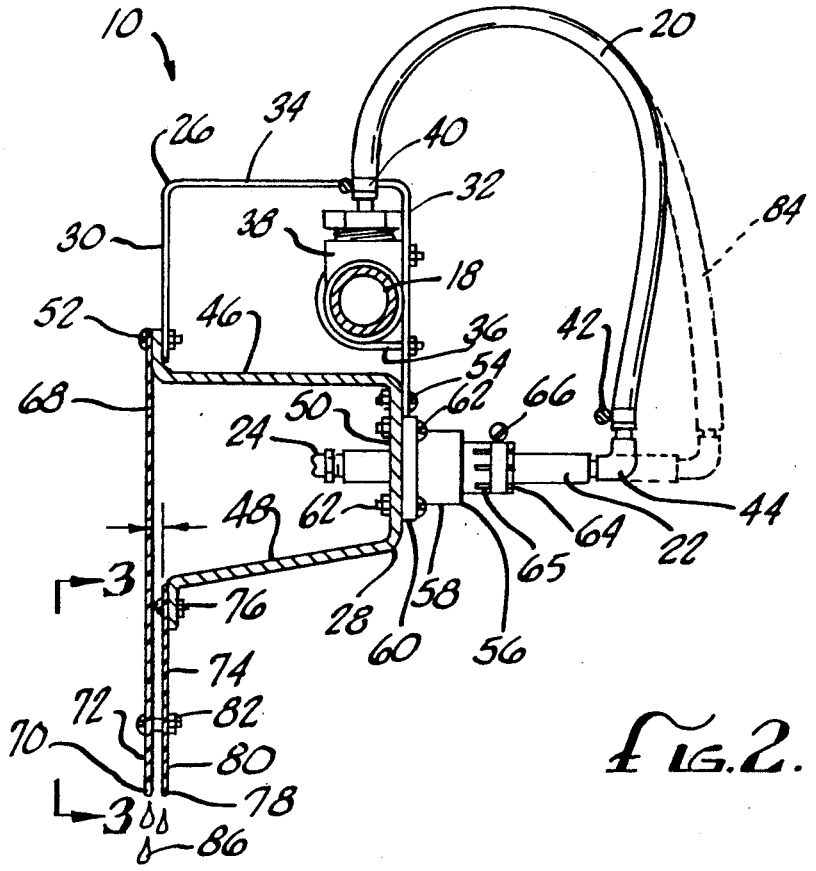
FIG. 2 is an enlarged cross-sectional view of the apparatus, showing a nozzle in position to spray water onto a collection sheet where it falls off in droplet form simulating the effect of real rain.

With reference now to FIG. 2, the manifold 18 and spray nozzles 24 are suspended above the tank 12 by a hanging bracket 26 and a spray nozzle housing 28 connected to the bracket. The hanging bracket 26 is a three-sided structure having a vertical front leg 30, a vertical back leg 32 and a horizontal top leg 34 connecting the front and back legs, with the open end of the bracket pointing downwardly. The manifold 18 is releasably connected to the back leg 32 of the bracket 26 by a suitable clamp 36. The feed lines 20 for each spray nozzle 24 are connected to the manifold 18 by a suitable T-fitting 38 in the manifold where they extend upwardly and then downwardly to the injector pipes 22. These feed lines 20 are releasably connected to the manifold 18 and injector pipes 22 by appropriate clamps 40 and 42, such as conventional hose clamps. An elbow 44 connected to the end of the injector pipe 22 outside of the spray nozzle housing 28 also may be used to facilitate connection of the feed line 20 to the injector pipe 22.

The spray nozzle housing 28 includes an upper horizontal wall 46 and a slightly shorter lower inclined wall 48 joined together at one end by a vertical side wall 50. The hanging bracket 26 and spray nozzle housing 28 are connected to each other by fasteners 52 and 54, such as nuts and bolts, in the manner shown in FIG. 2.

The spray nozzles 24 and injector pipes 22 are maintained in a horizontal position and are connected to the side wall 50 of the spray nozzle housing 28 by a coupling 56. The coupling 56 includes a cylindrical body 58 having an enlarged collar 60 at one end connected to the spray nozzle housing 28 by fasteners 62, for example, nuts and bolts. The other end of the coupling 56 has a reduced-diameter sleeve 64 adapted to slidably receive the injector pipe 22. The sleeve 64 also includes axial slots 65 on its outer end. Thus, when a clamp 66 around the sleeve 64 is tightened, it will contract the diameter of the sleeve and secure the injector pipe 22 within the coupling 56.

Figure 3:
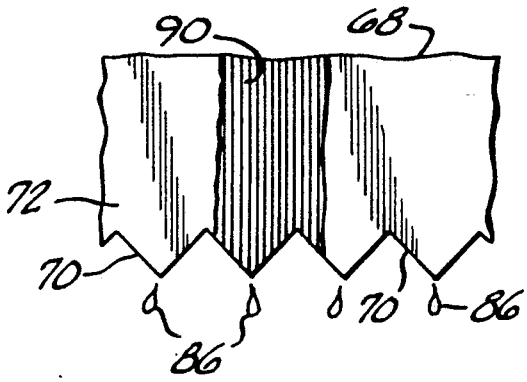
FIG. 3 is an elevational view of the apparatus, taken substantially along line 3—3 of FIG. 2.
Figure 4:
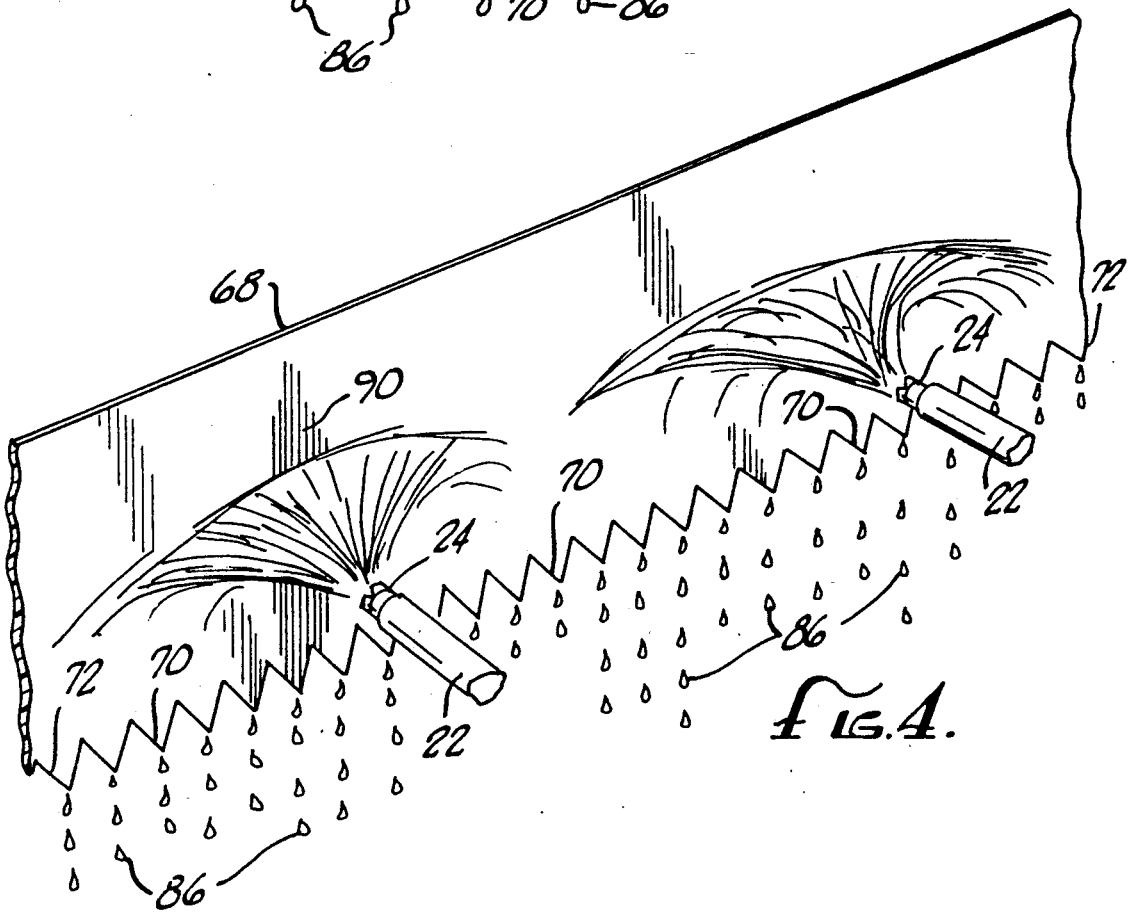
FIG. 4 is a perspective view of a portion of the apparatus, illustrating water being sprayed onto the collection sheet by the nozzles and falling off of the sheet in droplet form.

Referring now to FIGS. 2–4, the apparatus 10 further includes a substantially planar collection sheet 68 having a plurality of pointed teeth 70 along its lower edge 72. The collection sheet 68 is fastened to the upper wall 46 of the spray nozzle housing 28 in a vertical position by the same nuts and bolts 52 and 54 that connect the front leg 30 of the hanging bracket 26 to the upper wall 46 of the spray nozzle housing 28. It is noted that, depending on the horizontal length of the collection sheet 68 and its corresponding manifold 18, several hanging brackets 26 may need to be used to connect the apparatus 10 to a suitable overhead structure (not shown). As explained below, the pointed teeth 70 are arranged in a sawtooth pattern such that the water applied to the collection sheet 68 collects on the teeth and falls from them by gravity in droplet form.

As water is applied to the collection sheet 68 by the spray nozzles 24, a certain amount of water will bounce off of the sheet back into the spray nozzle housing 28. In order to collect this excess water not retained by the collection sheet 68, the apparatus 10 further includes a substantially planar overspray sheet 74 connected to the lower wall 48 of the spray nozzle housing 28 in a spaced, parallel relationship to the collection sheet 68 by a nut and bolt arrangement 76. Like the collection sheet 68, the overspray sheet 74 also includes a plurality of pointed teeth 78 along its lower edge 80 resembling a sawtooth pattern. Thus, water overspray is allowed to collect on the overspray sheet 74 where it falls by gravity to the pointed teeth 78 and releases as droplets. In the preferred embodiment, the lower wall 48 of the spray nozzle housing 28 is inclined in a direction toward the overspray sheet 74 to facilitate the movement of water out of the spray nozzle housing and down to the overspray sheet.

The space between the collection sheet 68 and the overspray sheet 74 is relatively narrow so as to prevent any overspray from falling between the two sheets. In the preferred embodiment, the spacing between the collection sheet 68 and the overspray sheet 74 is approximately 5/16 inch. To help maintain this spacing, a spacer 82 is inserted between the collection sheet 68 and the overspray sheet 74 at their lower ends. The spacer 82 can comprise a thin strip of expanded nylon or other suitable material. In this regard, it has been found that an expanded nylon spacer 82 acts as a further safeguard to help eliminate the uncontrolled ejection of overspray between the sheets 68 and 74, without having an appreciable effect on droplet formation by the pointed teeth 70 and 78 of two sheets.

Operation of the apparatus 10 for creating artificial rain will now be described. In normal use, water from the tank 12 is pumped through the supply line 16 by the pump 14 at approximately 12–20 psi. Water from the supply line 16 enters the manifold 18 where it is subsequently diverted by the feed lines 20 into the injector pipes 22. These pipes 22 in the preferred embodiment are spaced approximately 12 inches apart from each other. At this point, it should be understood that the total length of the collection sheet 68 and the total number of injector pipes 22 is determined by the size of the rain curtain being produced, limited only by the number of injector pipes that can be adequately supplied with water at the appropriate pressure.

The water preferably is emitted through the nozzles 24 in a thin, horizontal fan onto the collection sheet 68, as shown best in FIG. 4. The spray nozzles 24 are adjustably connected to the coupling 56 so they can be moved closer to or further away from the collection sheet 68 in order to provide appropriate water coverage onto the collection sheet. Adjustment of the nozzles 24 is accomplished by loosening the clamp 66 around the sleeve 64 of the coupling 56 and moving the injector pipe 22 within the coupling to the appropriate position. Thereafter, the injector pipe 22 and, thus, the spray nozzle 24 can be secured in the appropriate position by tightening the clamp 66. An illustration of an exemplary adjustment is shown by the dashed lines 84 of FIG. 2.

Application of water onto the collection sheet 68 in the manner described above forms a relatively uniform film of water on the sheet's surface. As the water reaches the lower edge 72 of the collection sheet 68, it begins to collect on the pointed teeth 70. Further, as the water begins to collect on the teeth 70, by definition its volume must be contained on a diminishing surface area extending from the base of the teeth to their pointed tips. As a result of water's inherent surface tension, the water begins to pool at the point of the teeth 70. When the water's volume and weight overcomes its surface tension, the pool of water releases as a falling droplet 86. Once the droplet 86 has released, it leaves a space for another droplet to form.

During the process of droplet formation on the collection sheet 68, any overspray from the spray nozzles 24 is captured by the spray nozzle housing 28 where it eventually collects on the overspray sheet 74 and forms droplets 86 in the same manner as the collection sheet. The droplets 86 of artificial rain falling from the collection sheet 68 and overspray sheet 74 are retrieved by a catch trough 88 located underneath the sheets 68 and 74 and, preferably, out of view by the guests or audience. The recaptured water is then returned to the tank 12 for further use.

In one aspect of the invention, the water-retaining surfaces of the collection sheet 68 and overspray sheet 74 may be scored to create a plurality of vertical grooves 90. These grooves 90 facilitate the flow of water down the sheets 68 and 74 in a uniform film. This assists in providing substantially the same amount of water to each tooth 70 and 78 and a more consistent number of drops 86 falling from each tooth.

When each of the droplets 86 releases from its associated tooth 70 or 78, it does so with a small change in angle from the preceding droplet. This phenomenon is caused by the fact that each tooth 70 or 78 is not identical, due to manufacturing tolerances, as well as possible wind conditions or drafts in the area. As a result, successive droplets 86 falling from the same tooth 70 or 78 will hit the catch trough 88 at different points. For example, it has been found that droplets 86 falling from the teeth 70 and 78 at a height of approximately 25 feet will hit the catch trough 88 up to 2–3 feet apart from each other. Therefore, it is necessary to have a catch trough 88 that is wide enough to collect the dispersed droplets 86. Importantly, the fact that each droplet 86 falls from its tooth 70 or 78 at a slightly different angle then the preceding droplet produces a random or broken pattern in the falling droplets. This substantially increases the realism of the effect, as the droplets 86 appear to more closely resemble real raindrops which also characteristically fall in a random pattern at different angles relative to the ground.

The flow and recycling of water through the apparatus 10 is regulated by a control system 92. As shown in FIG. 1, in the preferred embodiment, the control system 92 includes a pinch valve 94 in the supply line 16 that may be opened and closed to regulate the flow of water from the tank 12 to the manifold 18. A manual ball valve 96 in the supply line 16 downstream from the pinch valve 94 can be set to control the water pressure in the supply line under flow conditions. Optionally, a pressure gauge 98 also may be connected to the supply line 16 as a visual reference and safeguard to insure that the proper supply line water pressure is maintained. The control system 92 also includes a return line 100 having one end connected to the supply line 16 upstream from the pinch valve 94 and the other end emptying into the water tank 12. Like the supply line 16, the return line 100 includes a pinch valve 102 that opens and closes to regulate the flow of water through the return line. A manual ball valve 104 also is provided to regulate the water pressure in the return line 100 under flow conditions. Actuation of the pinch valves 94 and 102 in the supply line 16 and return line 100 is carried out by a three-way solenoid valve 106. The solenoid valve 106 regulates the flow of pressurized air from a pneumatic line 108 to the pinch valves 94 and 102 through pneumatic lines 112 and 114. The pinch valves 94 and 102 are therefore pneumatically operated to open and close the supply line 16 and the return line 100, respectively, in response to the operation of the solenoid valve 106 to regulate the flow of air to those valves. An exhaust line 110 also is provided to vent the lines 112 and 114 as may be necessary.

When the apparatus 10 is activated to produce artificial rain, the pinch valve 94 in the supply line 16 is opened and its associated manual ball valve 96 is pre-set for the appropriate supply line water pressure, as monitored by the fluid pressure gauge 98. The pinch valve 102 in the return line 100 is closed allowing water to run through the supply line 16 where it is emitted from the spray nozzles 24 in the manner described above. This is the normal operating mode for producing the artificial rain in accordance with the present invention. When it is desired to stop the rain, as may be desirable when a repeated show sequence is involved, as in a theme park installation, then the pinch valve 94 in the supply line 16 will be closed and the pinch valve 102 in the return line 100 will be simultaneously opened. This causes the water in the tank 12 to be recycled through a portion of the supply line 16 and the return line 100 so that the apparatus 10 remains constantly charged. In this regard, it is noted that the manual ball valve 104 in the return line 100 can be set to provide exactly the same pressure in the return line 100 as in the supply line 16. This, in turn, allows the pump 14 to operate at a constant pressure regardless of whether or not the apparatus 10 is activated to produce rain. Importantly, the manual ball valves 96 and 104 also balance the head pressure of the constant-run pump 14. Hence, since the water in the supply line 16 is trapped downstream from the closed pinch valve 94 in the supply line 16, opening of that pinch valve and closing of the return line pinch valve 102 allows the apparatus 10 to reactivate in only a few seconds to resume production of artificial rain.

The apparatus 10 of this invention provides several important advantages. In addition to the advantages of producing a more realistic artificial rain which can be activated and deactivated in a matter of seconds, as described in detail above, the apparatus itself is extremely light in weight. The lightweight nature of the apparatus 10 is afforded by the materials from which it is constructed. For example, the supply line 16, return line 100, manifold 18, injector pipes 22 and coupling 56 can all be manufactured from commercial available PVC plastic pipe. The feed lines 20 can be made of rubber, plastic or other flexible tubing. The spray nozzle housing 28 in the preferred embodiment is made of fiberglass, and the hanging bracket 26 is made of metal for secure connection to an overhead structure. Perhaps the heaviest component of the apparatus is the collection sheet 68 and overspray sheet 74, which are preferably constructed of metallic materials. Since the water tank 12, catch trough 88 and pump 14 are ground-based, their weight is not of as much concern. Therefore, any suitable metallic or plastic materials may be used to form the water tank 12 and catch trough 88. The pump 14 preferably is a submersible effluent pump, for example, Teel Model No. 2P355. The spray nozzles 24 used to produce the horizontal fan of water, in the preferred embodiment, are commercially available nozzles sold by Spraylat under Model No. 9504. These nozzles 24 have relatively large orifices and, therefore, are not prone to clogging from minerals, dirt or other impurities in the water.

Other advantages of the apparatus 10 include the fact that the water tank 12 can be filled with a minimal volume of water and be kept constantly charged, since the valve system described above allows for virtually instantaneous activation and deactivation of the apparatus. All this can occur without transient pressure changes which could damage the pump 14 or other equipment in the apparatus 10. Moreover, since water in the apparatus 10 is recycled from and into the water tank 12 by the catch trough 88, water needs to be added to the apparatus only to compensate for evaporation.

Since the system is kept constantly charged, and may be activated and deactivated in a manner of seconds, the apparatus 10 can be reliably operated on a daily basis without undue maintenance. This is especially important in theme park applications, where the apparatus 10 typically will be in operation from 10–12 hours per day, every day of the year, while being turned on and off as much as 100 times per day. The apparatus 10 also provides effective control and containment of the water, which is especially important in dry settings in theme parks.

From the foregoing description, it will be appreciated that the present invention provides an apparatus 10 for creating artificial rain that is much more natural and realistic in appearance when compared to the prior art devices. The apparatus 10 also can be rapidly activated and deactivated numerous times per day in an efficient and reliable manner, without undue concern for constant maintenance.

While a particular form of the invention has been illustrated and described, it will be apparent that various modifications can be made without departing from the spirit and scope of the invention. Accordingly, it is not intended that the invention be limited, except as by the appended claims.

I claim:

1. An apparatus for creating artificial rain, comprising:

(a) a collection sheet having droplet forming means along the lower edge thereof for creating artificial rain drops from liquid applied to the sheet; and (b) means for applying liquid onto the sheet comprising a plurality of spray nozzles adapted to spray a relatively flat, wide fan of liquid under pressure which forms a thin and evenly distributed film of liquid on the collection sheet, whereby substantially all of the liquid applied to the sheet is formed by the droplet forming means into drops that fall from the sheet.

2. The apparatus of claim 1, wherein the droplet forming means comprises a plurality of pointed teeth along the lower edge of the collection sheet.

3. The apparatus of claim 2, wherein the collection sheet is scored in a vertical direction from the lower edge of the sheet to at least the point where the fan of liquid is applied to the collection sheet.

4. The apparatus of claim 1, wherein the collection sheet is a substantially planar sheet positioned in a substantially perpendicular relationship to the fan of liquid emitted by the spray nozzles.

5. The apparatus of claim 1, further comprising an overspray sheet also having droplet forming means along the lower edge thereof, the overspray sheet being positioned in spaced relation and substantially parallel to the collection sheet.

6. The apparatus of claim 5, wherein the overspray sheet is smaller in vertical dimension than the collection sheet, but is substantially the same length, and wherein the lower edges of each sheet are aligned with each other.

7. The apparatus of claim 5, wherein the droplet forming means on the overspray sheet comprises a plurality of pointed teeth along the sheet's lower edge.

8. The apparatus of claim 7, wherein the overspray sheet is scored in a vertical direction.

9. The apparatus of claim 1, wherein the means for applying liquid to the collection sheet further comprises:

(a) a tank for holding a supply of water;
(b) a manifold connected to the tank by a supply line and to the plurality of spray nozzles; and
(c) a pump for moving the water under pressure from the tank through the supply line and manifold so that it can be sprayed in a controlled manner out of the nozzles onto the collection sheet.

10. The apparatus of claim 9, wherein the spacing between the collection sheet and the spray nozzles is adjustable.

11. The apparatus of claim 9, wherein each of the spray nozzles is connected to the manifold by a flexible feed hose.

12. The apparatus of claim 9, wherein the spray nozzles and collection sheet are connected to a housing having an upper horizontal wall and a slightly shorter lower downwardly inclined wall joined together at one end by a vertical side wall, with the collection sheet being connected in a vertical position to the upper horizontal wall so that it substantially covers the open end of the housing opposite the side wall, and with the spray nozzles being connected to the side wall of the housing in a perpendicular relationship to the collection sheet.

13. The apparatus of claim 12, wherein each of the spray nozzles is connected to the side wall of the housing by a coupling.

14. The apparatus of claim 13, wherein each of the spray nozzles includes a tube slidably received within the coupling so that the spacing between the nozzle and the collection sheet may be adjusted.

15. The apparatus of claim 9 further comprising a control system for controlling the flow of water from the tank through the supply line, manifold and spray nozzles.

16. The apparatus of claim 15, wherein the control system comprises:

(a) a first valve adapted to selectively open and close the supply line between the tank and the manifold;
(b) a second valve adapted to control the water pressure in the supply line under flow conditions;
(c) a return line connected to the supply line upstream from the first valve for selectively recycling water from the supply line into the tank when the first valve is closed;
(d) a third valve adapted to selectively open and close the return line; and
(e) a fourth valve adapted to control the water pressure in the return line under flow conditions.

17. An apparatus for creating artificial rain, comprising:

(a) a substantially planar collection sheet having a plurality of pointed teeth along the entire lower edge thereof; and
(b) means for applying liquid onto the sheet comprising a plurality of spray nozzles adapted to spray a relatively flat, wide fan of liquid under pressure which forms a thin and evenly distributed film of liquid on the collection sheet, such that the liquid moves down the sheet and collects on the pointed teeth where substantially all of the liquid applied to the sheet falls off in droplet form when the volume and weight of the liquid overcomes its surface tension.

18. The apparatus of claim 17, further comprising a substantially planar overspray sheet also having a plurality of pointed teeth along the lower edge thereof, the overspray sheet being positioned in spaced relation and substantially parallel to the collection sheet.

19. The apparatus of claim 18, wherein the collection sheet and the overspray sheet are scored in a vertical direction.

20. The apparatus of claim 17, wherein the means for applying liquid onto the collection sheet further comprises:

(a) a tank for holding a supply of water;
(b) a manifold connected to the tank by a supply line and to the plurality of spray nozzles; and
(c) a pump for moving the water under pressure from the tank through the supply line and manifold so that it can be sprayed in a controlled manner out of the nozzles onto the collection sheet.

21. The apparatus of claim 20, wherein the spacing between the collection sheet and the spray nozzles is adjustable.

22. An apparatus for creating artificial rain, comprising:

(a) a substantially planar collection sheet having a plurality of pointed teeth along the lower edge thereof;
(b) means for applying liquid onto the collection sheet such that the liquid moves down the sheet and collects on the pointed teeth where it falls off in droplet form when the volume and weight of the liquid overcomes its surface tension, the means for applying liquid onto the sheet including,
a tank for holding a supply of water,
a plurality of spray nozzles connected to the tank by a supply line, and
a pump for moving the liquid under pressure from the tank through the supply line so that it can be sprayed out of the nozzles onto the collection sheet; and
(c) a control system for controlling the flow of liquid from the tank through the supply line to the spray nozzles, the control system including,
a first valve adapted to selectively open and close the supply line between the tank and the nozzles,
a return line connected to the supply line upstream from the first valve for selectively recycling water from the supply line into the tank,
a second valve adapted to selectively open and close the return line, and
a control valve adapted to open the first valve and to close the second valve, when the apparatus is being operated to produce artificial rain, to thereby provide liquid flow from the tank to the spray nozzles, the control valve further being adapted to close the first valve and open the second valve, when the apparatus is not being operated, to thereby keep the control system and the supply line constantly charged by recycling liquid through the return line and the portion of the supply line upstream from the first valve, while simultaneously holding the liquid charge between the first valve and the spray nozzles.

23. The apparatus of claim 22, further comprising a third valve adapted to control the water pressure in the supply line under flow conditions and a fourth valve adapted to control the water pressure in the return line under flow conditions.

24. A method for creating artificial rain, comprising the steps of:

(a) providing a collection sheet having droplet forming means along a lower edge thereof; and (b) applying a film of liquid onto the collection sheet by spraying a relatively flat, wide fan of liquid under pressure toward the collection sheet and forming a thin and evenly distributed film of liquid on the collection sheet so that substantially all of the liquid applied to the sheet is formed by the droplet forming means into drops that fall from the sheet.

25. The method of claim 24, further comprising the steps of:

(a) providing an overspray sheet also having droplet forming means along a lower edge thereof; and (b) spacing the overspray sheet next to the collection sheet so that the overspray sheet may collect excess liquid not retained by the collection sheet during the application of liquid onto the collection sheet.

26. The method of claim 24, further comprising the (a) recovering the liquid drops that fall from the collection sheet; and (b) returning the liquid drops to a tank supplying liquid for application to the collection sheet.

27. The method of claim 24, wherein the liquid is water applied to the collection sheet by a plurality of spray nozzles.

28. The method of claim 27, further comprising the step of controlling the amount of water sprayed through the nozzles onto the collection sheet.

29. The method of claim 28, wherein the step of controlling the amount of water sprayed through the nozzles is carried out by valve means in a supply line adapted to supply water under pressure from a water tank to the nozzles.

30. The method of claim 29, further comprising the step of recycling the water in the tank through a return line connected between the supply line and the tank when the valve means is closed and water is not being sprayed through the nozzles.

31. An apparatus for creating artificial rain, comprising:

(a) a collection sheet having first droplet forming means along the lower edge thereof for creating artificial rain drops from liquid applied to the sheet;

(b) an overspray sheet having second droplet forming means along the lower edge thereof, the overspray sheet being positioned in a spaced relation with respect to the collection sheet so as to collect any excess liquid not retained by the collection sheet; and (c) means for applying liquid onto the collection sheet comprising a plurality of spray nozzles adapted to spray a relatively flat, wide fan of liquid under pressure which forms a thin and evenly distributed film of liquid on the collection sheet, such that substantially all of the liquid applied to the collection sheet and any excess liquid retained by the overspray sheet are formed by the first and second droplet forming means into drops that fall from the collection sheet and the overspray sheet.

32. The apparatus of claim 31, wherein the first and second droplet forming means comprise a plurality of pointed teeth along substantially the entire lower edge of each of the collection sheet and the overspray sheet.

33. The apparatus of claim 32, wherein each of the collection sheet and the overspray sheet is scored in a vertical direction on the surface of the sheets to which the liquid is applied or collected.

* * * * *